United States Patent [19]

Chapin et al.

[11] 4,112,901

[45] Sep. 12, 1978

[54] FUEL SYSTEM WITH METERING PUMP FOR INTERNAL COMBUSTION ENGINES

[75] Inventors: Leonard Lee Chapin; James Walter Merrick, both of El Paso, Tex.

[73] Assignee: Autotronic Controls, Corp., El Paso, Tex.

[21] Appl. No.: 783,610

[22] Filed: Apr. 1, 1977

[51] Int. Cl.[2] ..... F02M 39/00

[52] U.S. Cl. ..... 123/139 E; 261/36 A; 261/66; 261/27; 123/139 AW

[58] Field of Search .... 123/139 E, 139 AW, 139 BC, 123/119 R, 32 EA, 139 R; 261/36 A, 27, 66; 60/39.28 R

[56] References Cited

U.S. PATENT DOCUMENTS

| | | | |
|---|---|---|---|
| 3,587,547 | 6/1971 | Hussey | 123/139 E |
| 3,669,081 | 6/1972 | Monpedit | 123/139 E |
| 3,724,436 | 4/1973 | Nagata et al. | 123/139 E |
| 3,817,225 | 6/1974 | Priegel | 123/139 E |
| 3,913,547 | 10/1975 | Wentworth et al. | 123/139 E |
| 4,046,113 | 9/1977 | Moore | 123/139 E |

*Primary Examiner*—Charles J. Myhre
*Assistant Examiner*—R. A. Nelli
*Attorney, Agent, or Firm*—Fitch, Even, Tabin & Luedeka

[57] ABSTRACT

A fuel supply system supplies volatile fuel at a controlled rate to an air-fuel mixing chamber leading to a subatmospheric intake manifold of an internal combustion engine. Fuel is metered out by a metering gear pump supplied with fuel under pressure sufficient to maintain the fuel in its liquid state. An equalizer valve maintains the pressures on the two sides of the gear pump equal. This assures linearity of fuel rate as a function of pump speed. Pump speed is measured to provide a feedback signal to a controller. The controller compares the feedback with a control signal indicative of desired rate of fuel to develop driving power for application to the gear pump to drive the latter at the speed that supplies fuel at the desired rate.

20 Claims, 16 Drawing Figures

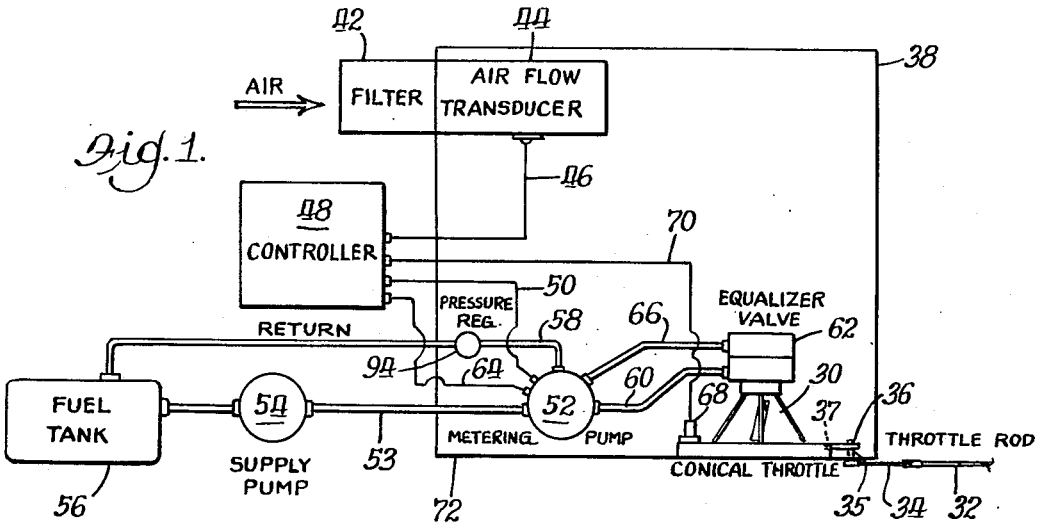
Fig. 1.
Fig. 2.
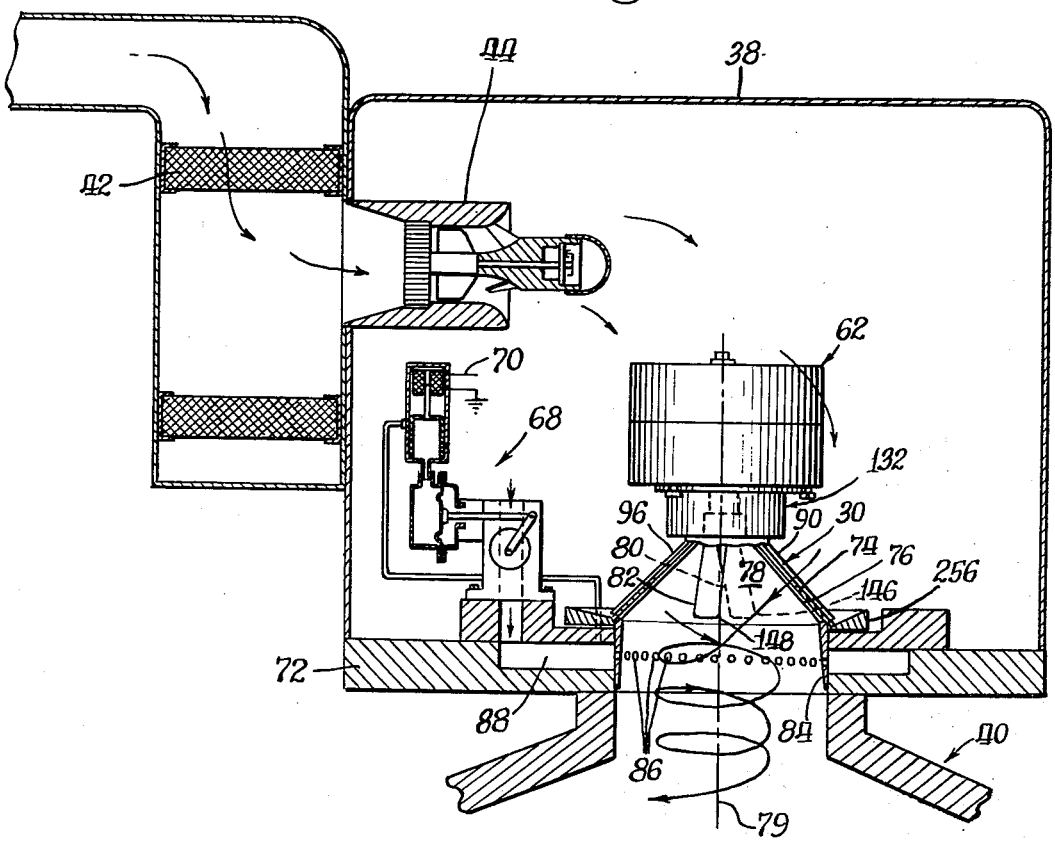

Fig. 5.
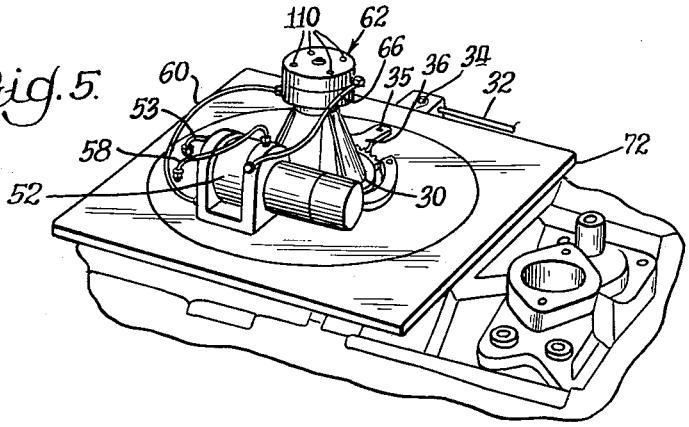
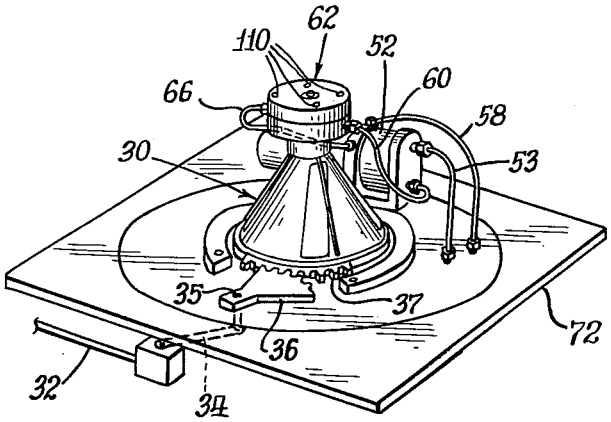
Fig. 6.
Fig. 7.
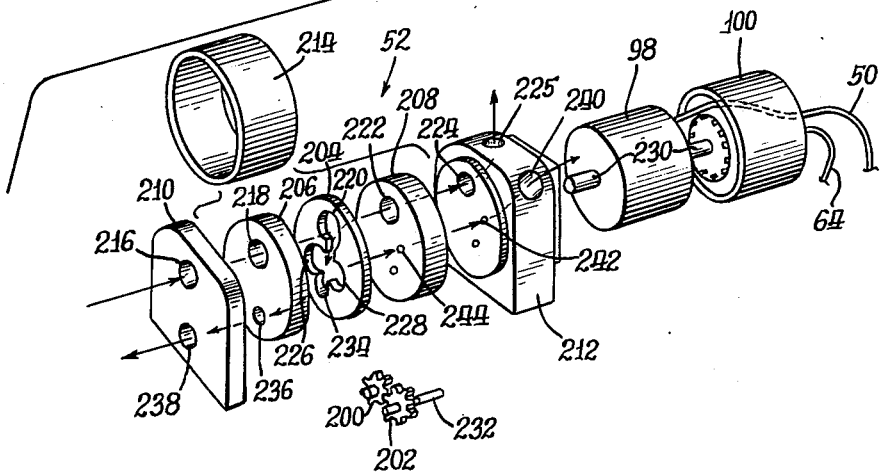

260
79
262

264
74
258
264
76
82
80
78
148
146
86
84

258

258
14
14
258
258

74
258
264
264

FUEL SYSTEM WITH METERING PUMP FOR INTERNAL COMBUSTION ENGINES

SUMMARY AND BACKGROUND

This invention relates to fuel supply systems for supplying volatile fuel at a controlled rate to an air-fuel mixing chamber leading to the subatmospheric intake manifold of an internal combustion engine and more particularly to such systems where a metering gear pump is used to supply fuel at a controlled rate and still more particularly where the gear pump is operated at elevated pressures and a low pressure differential.

It is well known to control fuel flow in an internal combustion engine, especially to maintain an appropriate air/fuel ratio, as is disclosed in Priegel U.S. Pat. No. 3,817,225, issued June 18, 1974 for "Electronic Carburetion System for Low Exhaust Emissions of Internal Combustion Engines." Priegel discloses a system wherein the rate of air flow and certain other parameters are measured and used to control the drive of a positive displacement metering pump to supply fuel at an appropriate air/fuel ratio.

It has also been suggested, as shown in Milam U.S. Pat. No. 3,643,635, issued Feb. 22, 1972 for "Electronic Fuel Injection System," that such controlled fuel supply systems utilize gear pumps for the fuel metering pumps. Gear pumps have not previously proven satisfactory for such purposes, however, as they have not provided proper response to the control signals. That is, they have not pumped fuel at the rate demanded by the control signals. It has now been discovered that inaccuracy is not inherent in metering gear pumps, and that the problems have arisen from two sources, gas bubbles in the system and leakage through the pump.

Gas bubbles passing through a metering pump displace liquid fuel. As metering pumps are volumetric, the rate of fuel flow is decreased when gas bubbles pass through the pump, making the air/fuel mixture leaner than demanded by the control signals. As the fuel used in internal combustion engines is highly volatile and as the engines operate at high temperatures, frequently ambient conditions produce hot spots in the fuel system that generate such bubbles, particularly at high ambient temperatures and low ambient pressures. (This is what causes the well known vapor lock in conventional fuel induction systems.) Such conditions also may produce cavitation at the pump impellers, similarly spoiling the metering capability of the pump. The problem is aggravated where the fuel is supplied to a subatmospheric mixing chamber, as is typical of internal combustion engines with intake manifolds pumped out by piston action.

Leakage is a problem because gear pumps and other rotary positive displacement pumps do not have positive seals in the pumping structure. The pumps therefore leak when there is any substantial pressure differential between the two sides of the pumps.

Both problems are present in systems like that of Milam. Milam utilizes a low pressure pump to supply fuel at low pressure to the intake side of a metering gear pump, thus producing conditions under which bubbles may be produced. At the same time Milam utilizes his gear pump to produce substantial pressure necessary to overcome the force of a biasing spring and to force fuel into the mixing chamber at proper velocity. Such pressure causes leakage of fuel back through the pump so that fuel flow is not linear with pump speed.

The problem of bubbles and cavitation can be minimized by supplying fuel to the metering pump at a relatively high pressure as assures that the fuel remains in its liquid phase. This, however, makes the problem of leakage worse, and the pumps leak fuel even when stationary. It has been suggested that the leakage problem can be reduced by keeping the pressure differential across the pump relatively constant so that leakage is constant and can be allowed for. See, for example, Meyer et al. U.S. Pat. No. 3,908,360, issued Sept. 30, 1975 for "Pump Metering Fuel Control System." However, any system requiring allowance to be made for leakage is inherently inferior to a measuring system where pump speed is proportional to fuel flow and can be taken directly as a measure of fuel flow. Also, this requires wasteful pumping just to offset the leakage loss.

It is therefore a primary object of the invention to provide a fuel supply system for supplying volatile fuel at a controlled rate to an air-fuel mixing chamber leading to a subatmospheric intake manifold of an internal combustion engine utilizing a metering rotary positive displacement pump, the output of which is proportionally related to rate of fuel flow, whereby a measure of pump speed may be fed back for use with a control signal to drive the pump at the desired rate. In accordance with the present invention, means are provided to supply the fuel to the inlet side of a metering gear pump at a substantial elevated pressure at which the fuel remains liquid passing through the gear pump. Whereas this would aggravate the leakage problem is the discharge side of the gear pump went directly to the subatmospheric pressure in the mixing chamber, the present invention provides an adaptation of the ancient flow control apparatus shown in Callan U.S. Pat. No. 1,272,212, issued July 9, 1918 for "Flow Controlling Apparatus," wherein leakage is precluded by equalization of the pressures on the two sides of the gear pump.

The Callan apparatus is for spinning filaments. The inlet pressure to the gear pump of Callan need only be sufficient to exceed the pressure required to deliver the desired quantity of fluid, as Callan states at page 1, lines 32 to 34. Further, there is no positive closure for Callan's equalizer valve, so that leakage from the valve is minimized only by the balance of pressures on the two sides of the diaphragm of the valve, as stated by Callan at page 2, lines 100 to 111. In gasoline engines, this is not good enough.

Thus, in accordance with the present invention, the equalizer valve includes a valve body forming a valve chamber with an outlet opening therein, a resilient diaphragm mounted in the chamber, and a valve closure member supported by the diaphragm for closing the outlet opening, with the diaphragm dividing the chamber in two parts and mounted for movement by pressure differentials between the two parts, one part being coupled to the inlet side of the gear pump and the other part being coupled to the discharge side. The diaphragm is biased for positive closure of the outlet opening by the valve closure member when the pressure on the discharge side is less than a small predetermined differential greater than the pressure on the inlet side, such small predetermined differential being insufficient to produce any substantial leakage through the gear pump. This assures positive closure when the gear pump is stopped, as when no fuel is demanded, so that fuel will not leak into the engine. However, unlike the operation of devices of Milam or Meyer et al., the pressure differential limit at which the valve is opened is so low that there is no substantial leakage through the gear pump, assuring proportionality of output as a function of speed.

A further object of the invention is to provide a fuel distribution system having a flow splitter for distributing fuel flow from a supply conduit to a plurality of fuel passages for separately directing the fuel to the mixing chamber.

Various other objects and advantages of the present invention will become apparent from consideration of the following detailed description, particularly when taken in conjunction with the accompanying drawings in which:

BRIEF DESCRIPTION OF DRAWINGS

FIG. 1 is a diagrammatic illustration of a controlled air-fuel system for an internal combustion engine utilizing the fuel supply system of the present invention;

FIG. 2 is a vertical sectional view of the air flow system shown generally in FIG. 1;

FIG. 5 is a simplified isometric view of a modified form of a portion of the system shown generally in FIGS. 1 to 3 similarly mounted on an intake manifold;

FIG. 6 is a similar isometric view of the apparatus shown in FIG. 5, taken from the other side of the unit;

FIG. 7 is an exploded view of the fuel pump, pump motor and tachometer shown in FIG. 3;

DESCRIPTION

Figure 3:
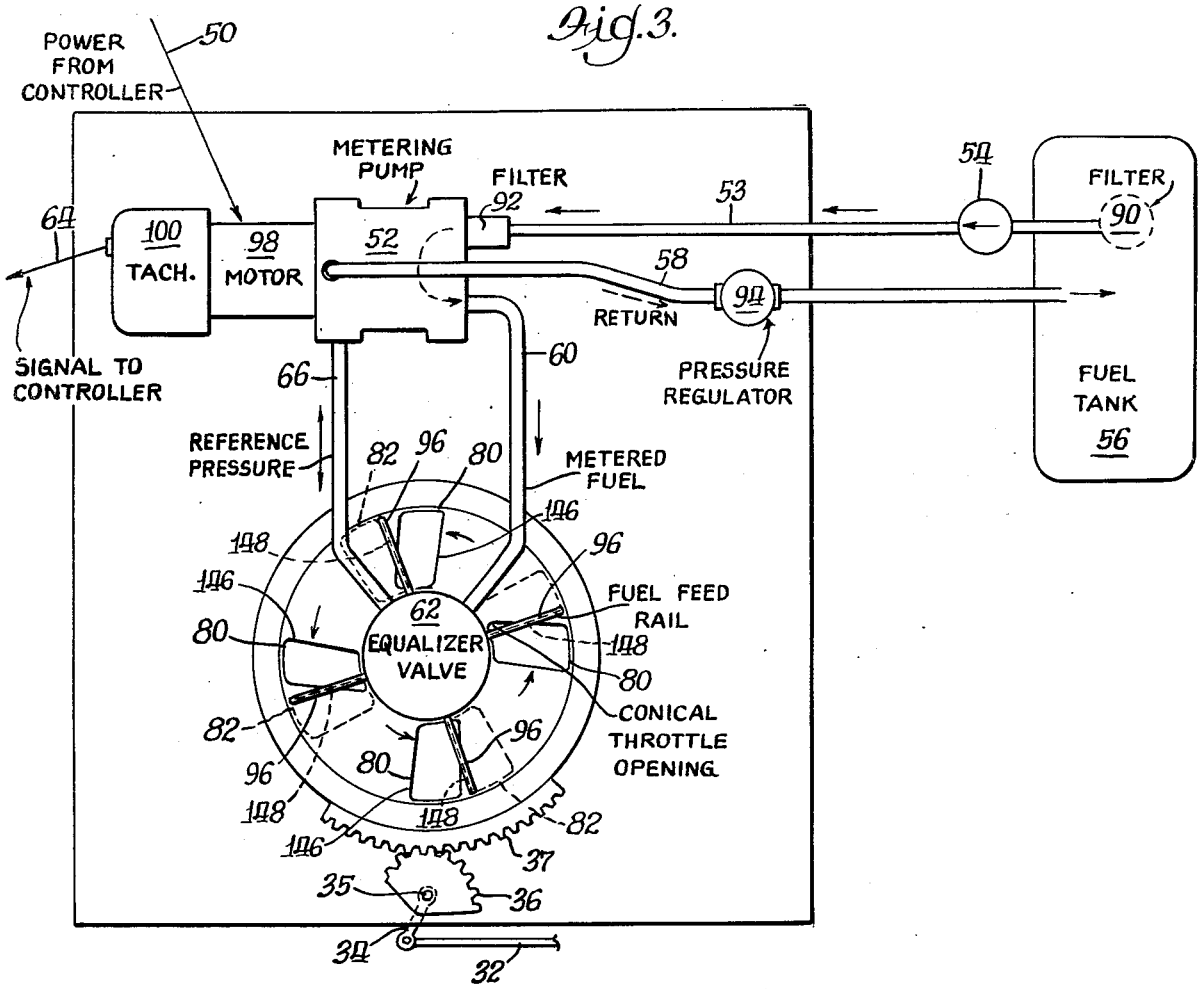
FIG. 3 is a plan view of the fuel supply system shown generally in FIG. 1.

As stated above, the present invention is particularly useful in internal combustion engines having air-fuel control systems wherein fuel is supplied in metered amounts providing a particular desired ratio of air to fuel for engine operation. In such systems, air flow to the intake manifold of the engine is controlled and measured, and air flow rate, usually in conjunction with other parameters, is used to develop a control signal used for providing fuel at the desired air/fuel ratio. Thus, the present invention may be utilized in fuel control systems such as that described in U.S. Pat. No. 3,817,225, issued June 18, 1974 to Jack C. Priegel.

In FIG. 1 there is illustrated very generally an air and fuel control system like that shown by Priegel for supplying an appropriate mixture of air and fuel to the intake manifold of an internal combustion engine, which system has been modified, among other things, to utilize the fuel supply system of the present invention.

More particularly, the system of FIG. 1 includes a carburetor 30 which, as shown, is preferably conical. As a principal function of the carburetor 30 is to control the rate of flow of air to an intake manifold of an engine, the conical carburetor 30 is sometimes referred to as a conical throttle. The opening of the throttle is controlled by a throttle rod 32 which may be connected, for example, to a conventional automobile accelerator pedal. The throttle rod 32 may be connected through a crank 34, a shaft 35 and gears 36 and 37 to control the throttle opening and hence the rate of flow of air into the intake manifold. The conical throttle is enclosed in a housing 38 which fits over the intake manifold 40 of an internal combustion engine, as better seen in FIGS. 2 and 4, with the interior of the housing 38 being open to the intake manifold 40 through the carburetor 30. The throttle control linkage passes through the housing 38 at the shaft 35.

All air flowing into the intake manifold flows through the housing 38, flowing into the housing through a filter 42 and an air flow transducer 44. The air flow transducer 44 measures the rate of air flow into, and hence out of, the housing 38 by producing a systematically related electrical signal on a conductor 46 which goes to an appropriate controller 48. The controller 48 may receive other signals from other sensors, such as temperature and pressure sensors, and may operate generally like the controller described in Priegel U.S. Pat. No. 3,817,225, utilizing the various signals to provide an appropriate fuel control signal on a conductor 50 to a metering pump 52.

The metering pump 52 is supplied with fuel through a conduit 53 by a supply pump 54 from a fuel tank 56 with any excess fuel being returned to the fuel tank 56 through a return conduit 58. The metering pump 52 supplies fuel to the carburetor 30 through a conduit 60 and an equalizer valve 62. A feedback signal indicative of pump speed is applied over a conductor 64 to the controller 48, which utilizes the feedback signal to assure that the metering pump operate at the desired speed. Reference pressure is applied to the equalizer valve 62 through a conduit 66.

Also illustrated generally in FIG. 1 is a bypass throttle 68 which operates as an auxiliary air control for admitting a controlled additional amount of air into the intake manifold 40, as may be called for by a signal developed in the controller 48 and applied to the bypass throttle over a conductor 70.

It should be noted that each of the conductors 46, 50, 64 and 70, shown as a single line in FIG. 1, may comprise a pair of conductors to provide a return path for completion of the respective signal circuit As shown more particularly in FIG. 2, the housing 38 includes a base 72 which is mounted on the intake manifold 40 and on which the carburetor 30 is mounted, with the outlet of the carburetor 30 directly over the inlet to the intake manifold 40. The carburetor 30 is formed of a pair of valve members 74 and 76. The valve members 74 and 76 are preferably in the form of conical shells, as illustrated, and hence may be referred to as the outer cone 74 and inner cone 76, respectively. Both cones are hollow, the inner surface of the inner cone 76 forming a mixing chamber 78 wherein fuel and air are mixed.

The inner cone 76 is rigidly fastened to the base 72; whereas the outer cone 74 is rotatably mounted above the inner cone 76 with the inner cone nesting in the outer cone. That is, the outer surface of the inner cone 76 and the inner surface of the outer cone 74 are formed as surfaces of revolution about an axis 79 which, in the case of the carburetor illustrated, is a vertical axis down the centers of the cones. The outer cone 74 may thus be rotated about this axis relative to the inner cone 76 by operation of the throttle rod 32. To facilitate relative rotation, the outer cone may be mounted on bearing surfaces, keeping the mating surfaces slightly spaced from one another, reducing likelihood of binding. The inner cone is made fixed because it is fully exposed to the manifold vacuum, and the outer cone is relatively gently held against the inner cone by the relative pressures on the two sides of the outer cone. Were the outer cone fixed, the inner cone would be pulled away therefrom by the manifold vacuum, requiring additional means, such as a spring, to hold them together to limit air leakage between the cones.

As better shown in FIG. 3, the outer cone 74 includes a plurality of first openings 80 which are substantially identical to one another and are equally spaced around the axis of the cone 74. The inner cone 76 has a plurality of second openings 82 corresponding to the first openings in the outer cone whereby, when the cones are rotated relative to one another, the amount of overlap of the respective openings changes.

The inner cone 76 terminates in a skirt section 84 perforated by holes 86 that furnish passages for air between a channel 88 in the base 72 and the interior of the inner cone 76. The holes 86 and the channel 88 provide passages for air flowing through the bypass throttle 68.

FIG. 3 illustrates the fuel feed system of FIG. 1 with greater particularity. The disclosed fuel feed system supplies fuel at a metered rate from the reservoir or fuel tank 56 to the overlapping first and second openings 80 and 82 of the carburetor 30. Fuel is pumped from the fuel tank 56 by the supply pump 54 through a filter 90 in the fuel tank 56 and hence through the conduit 53 to the inlet to the metering pump 52, where it passes through a second filter 92. The second filter 92 may take the form of a flow-through filter formed as a tube connecting the conduit 53 to the return conduit 58 so as to make the second filter self cleaning, the filtered fuel going to the metering pump through the wall of the tube. The fuel pumped by the supply pump 54 to the metering pump 52 that is in excess of the demand of the pump 52 passes on to the return conduit 58, whence the excess fuel returns to the fuel tank 56 through a pressure regulator valve 94. The pressure regulator valve 94 regulates the fuel pressure at the inlet side of the metering pump 52, that is, upstream of the gears, maintaining such pressure sufficiently high as substantially to preclude the formation of bubbles in the fuel. Pressures in excess of 30 psi have proven satisfactory, for example, about 40 psi. Bubbles are undesirable, as they displace liquid and hence would make the metering pump nonlinear. The inlet pressure is applied through the conduit 66 to one side of the equalizer valve 62. The metering pump 52, which is a rotary positive displacement pump, more specifically a gear pump, supplies fuel at a metered rate, as will be described below, through the conduit 60 to the other side of the equalizer valve 62 and thence through rails 96 and the overlap of the openings 80 and 82 into the mixing chamber 78 in the interior of the conical throttle 30.

The rate at which the metering pump 52 operates is determined by the speed of a metering pump motor 98 which drives the metering pump 52 itself. The speed of the motor 98 is controlled by the power supplied to the motor 98 from the controller 48 over the conductor 50. The speed at which the motor 98 and, hence, the metering pump 52 operate is measured by a tachometer 100 which produces a signal on the conductor 64 which indicates pump speed.

The metering pump 52, particularly when used with the equalizer valve 62 described more fully below in connection with FIG. 8, operates to pump liquid at a rate proportional to the speed of the pump; hence the signal indicative of motor and pump speed is a measure of rate of fuel flow. This signal is applied as a feedback signal to the controller 48. The controller 48 may operate as the controller disclosed in the aforesaid Priegel U.S. Pat. No. 3,817,225 to compare a signal dependent upon air flow with the feedback signal to produce a driving signal to the motor 98 over the conductor 50 to supply fuel to the rails 96 at the appropriate air/fuel ratio for which the controller is programmed.

Figure 4:
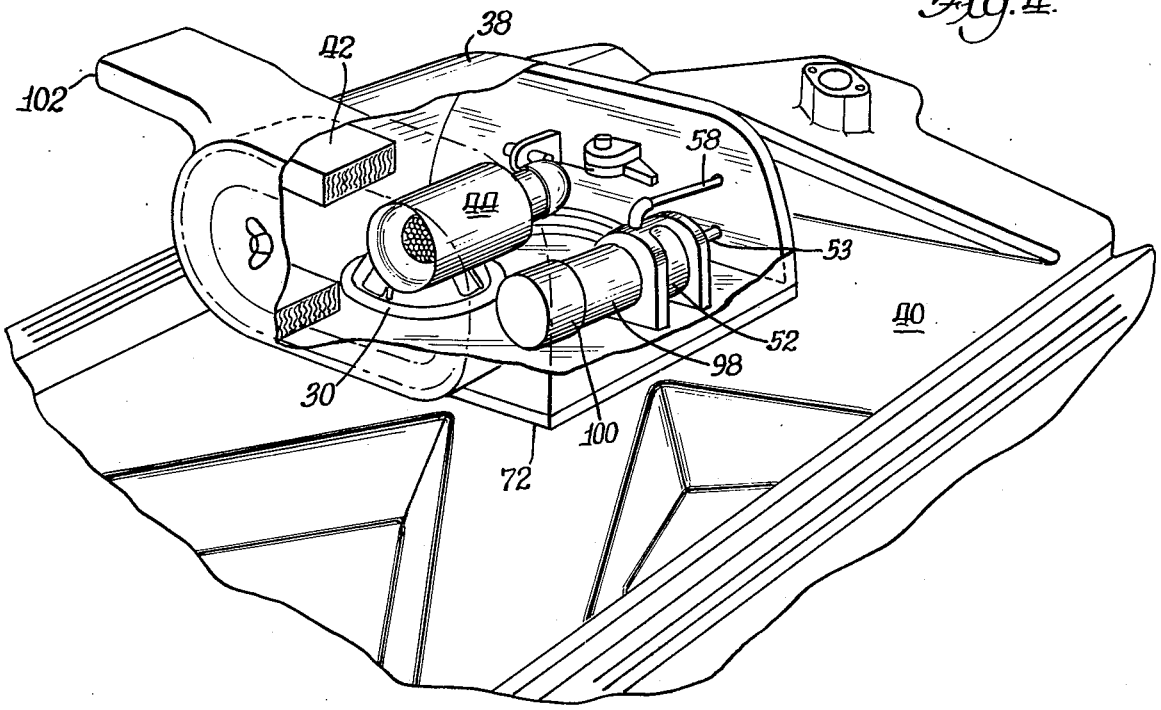
FIG. 4 is an isometric view of the mechanical parts of a specific system of the sort shown generally in FIGS. 1 to 3, with the components mounted on the intake manifold of a piston driven gasoline engine and with portions partly broken away.

FIG. 4 illustrates one form of air/fuel control system utilizing the fuel supply system of the present invention as mounted in place over the intake manifold 40 of an internal combustion engine. FIG. 4 illustrates one manner in which the various system components may be assembled within the housing 38 on the baseplate 72. The housing 38 has been broken away to show the arrangement of the system components. Air is taken into the system through an air intake 102 and thence through the filter 42. The filtered air passes through the air flow transducer 44 into the interior of the housing 38, which houses the carburetor 30 and the metering pump 52. The metering pump 52 is driven by the pump motor 98 and its speed is measured by the tachometer 100. Fuel from the supply pump 54 is supplied through the conduit 53 to the fuel pump 52 with the return flow through the conduit 58.

FIGS. 5 and 6 are simplified views of a modified form of the system of the present invention showing the carburetor 30 and the metering pump 52 mounted on the baseplate 72 and the connections therebetween. Other parts of the system that are normally within the housing 38 have been deleted to facilitate an understanding of these connections. In this form of the invention the conduits 53 and 58 to and from the fuel tank 56 extend through the baseplate 72. FIG. 6 shows the same apparatus as FIG. 5 but from the opposite side.

FIG. 7 is an exploded view of the fuel pump 52, the pump motor 98 and the tachometer 100, as will be described in greater detail below.

Figure 8:
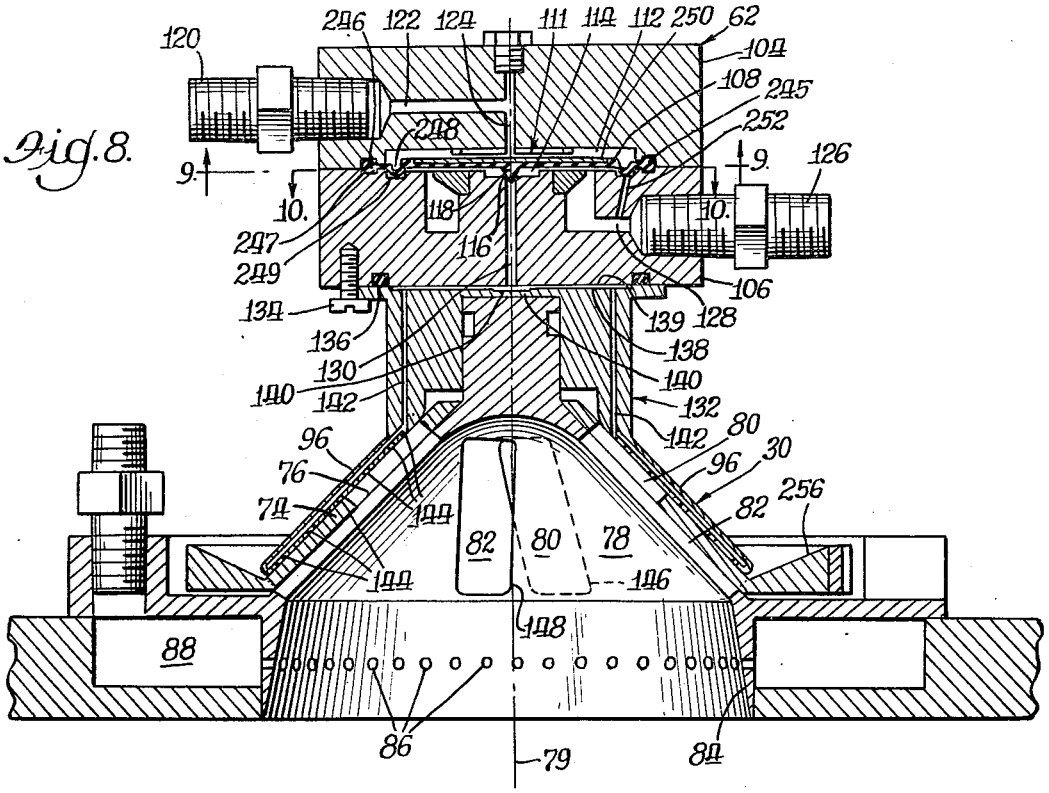
FIG. 8 is an enlarged axial vertical sectional view of the carburetor shown in FIG. 2 as mounted in place on a mounting plate with an equalizer valve and flow splitter.

FIG. 8 is an enlarged vertical sectional view of the carburetor 30 of the present invention with the equalizer valve 62, also shown in section, in its operating position mounted on the carburetor 30. As shown, the equalizer valve 62 preferably comprises an upper member 104 and a lower member 106 with a flexible diaphragm 108 clamped therebetween, as by the use of screws 110 (see FIGS. 5 and 6). The upper and lower members are shaped to form a valve chamber 111 divided into two parts by the diaphragm 108, an upper part 112 and a lower part 114. The lower part 114 has an outlet orifice 116. The diaphragm 108 carries a pointed valve closure member 118 which cooperates with the outlet orifice 116 to form a needle valve. The pump reference pressure is applied through the conduit 66 to a fitting 120 which couples the reference pressure through conduits 122 and 124 to the upper part 112 of the valve chamber. Metered fuel is supplied through the conduit 60 to a fitting 126. Thence, it passes through a passage 128 to the lower part 114 of the valve chamber 111.

Figure 9:
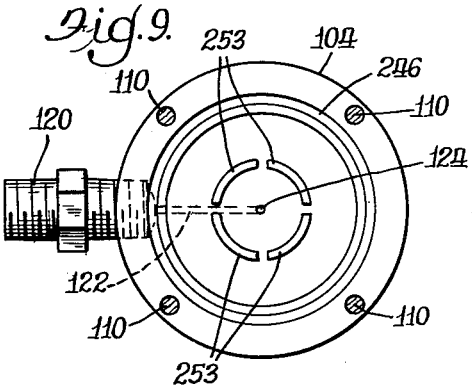
FIG. 9 is a bottom view of the top portion of the equalizer valve shown in FIG. 8.
Figure 10:
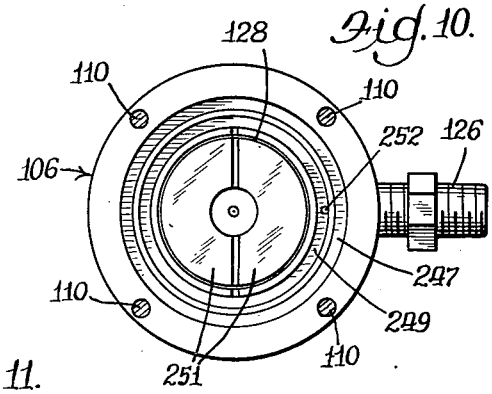
FIG. 10 is a plan view of the bottom portion of the equalizer valve shown in FIG. 7.
Figure 11:
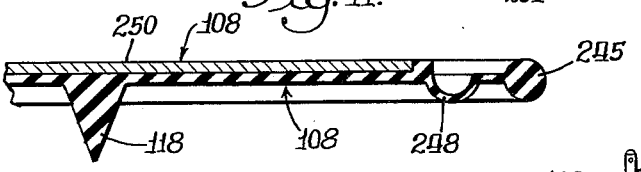
FIG. 11 is an enlarged sectional view of the diaphragm shown in FIG. 8.

With the metering pump 52 stopped, the pressures in the two parts 112 and 114 of the valve chamber 111 are equalized, and the diaphragm 108 is biased to cause the valve closure member 118 to close the outlet orifice 116. When the metering pump motor 98 is energized, it turns the metering pump 52 at the speed to supply fuel at the desired rate to the lower part 114 of the valve chamber 111, increasing the pressure therein, and hence forcing the diaphragm 108 upward and unseating the valve closure member 118, whereupon the metered amount of fuel passes through the orifice 116 and thence through a conduit 130 through the lower member 106 to a flow splitter 132. As the pressure needed to unseat the valve closure member 118 is relatively low, the pressure differential across the metering pump is small, limiting pump leakage during pumping, and as the valve closure member is seated at pump standstill, precluding leakage at standstill, proportionality of fuel rate with pump speed is maintained, while at the same time permitting operation at the relatively high pressure desired for precluding the formation of bubbles. The equalizer valve 62 will be described in greater detail in connection with the fuller description of the pump 52 as shown in FIG. 7. The details of the parts of the equalizer valve shown in FIG. 9, 10 and 11 will also be there described.

Figure 12:
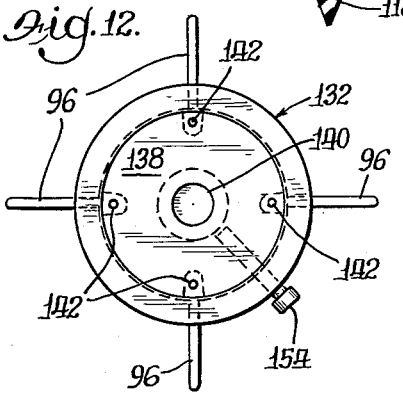
FIG. 12 is a plan view of the fuel splitting mechanism shown in FIG. 8.
Figure 13:
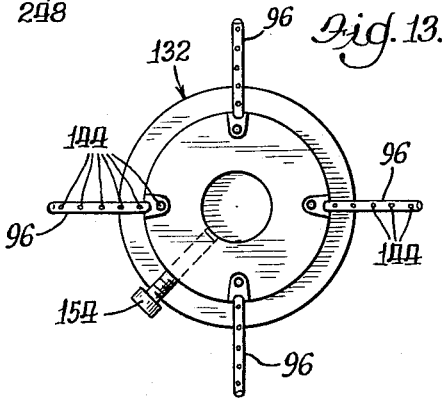
FIG. 13 is a bottom view of the structure of FIG. 12.

The flow splitter 132 is clamped to the lower member 106 by screws 134 and is sealed thereto by an O-ring 136. The flow splitter has a flat upper surface 138 displaced from the lower surface 139 of the lower member 106, which is also flat, by a relatively thin space which may be about 0.0015 inches. A cut out central section of the flow splitter 132 provides a receptacle 140 at the end of the conduit 130 to receive the fuel passing through the conduit 130. The receptacle 140 also distributes the fuel around the receptacle 140 to the thin space between the wall 139 of the lower member 106 and the upper surface 138 of the flow splitter 132. The thin space provides a constriction in the fuel flow path which causes the fuel to spread out in all directions, the space being so narrow as to assure substantially equal flow in all directions. A plurality of fuel passages 142 extend through the upper surface 138 to provide exit passages for fuel passing through the space between the flow splitter 132 and the lower member 106. The flow passages 142 are equally distributed about the central axis of the unit so that equal amounts of fuel flow through the respective fuel passages 142. The flow splitter 132 is shown in greater detail in FIGS. 12 and 13.

The fuel passages 142 extend down to the fuel rails 96, the fuel rails 96 having a plurality of outlet orifices 144. The fuel flows out of the orifices 144 through the overlaps of openings 80 and 82 into the mixing chamber 78 of the carburetor 30. A more detailed description of the flow of the fuel from the fuel rails into the mixing chamber will be given below.

FIGS. 2, 3 and 8 show generally the relative disposition of the fuel rails 96 and the openings 80 and 82. In general, each of the openings has a radial edge, that is, an edge extending along the respective cone in a plane including the axis of the cone. Thus, each first opening 80 in the outer cone 74 includes a radial edge 146 and each second opening 82 in the inner cone has a radial edge 148. The openings may be generally in the shape of parallelograms, as illustrated.

The orifices formed by the valve members 74 and 76 at the overlapping of the respective first openings 80 and second openings 82 are effectively constrictions in the air flow. Were the valve members 74 and 76 made so thin as to have no substantial thickness, the constrictions at the openings 80 and 82 would be substantially perpendicular to axial planes. Flow through each constriction would hence be directed toward the axis where, in the symmetrical configuration illustrated, it would meet air coming through an opposing constriction, creating turbulence and directing the flow downward and out of the mixing chamber. In the system illustrated it has been found desirable to cause the air to swirl within the mixing chamber 78 before passing therefrom so as to remain longer in the chamber and facilitate evaporation of the fuel and mixture of fuel droplets with the air.

To achieve this swirling the valve members 74 and 76 are made of substantial thickness. Thus, when the respective surfaces of revolution of the valve members 74 and 76 nest one within the other, the other surfaces of the members 74 and 76 are displaced from the nesting surfaces in opposite directions. The thickness of the members 74 and 76 make the constriction at the overlapped openings other than perpendicular to the plane of the axis 79. The flow through the constriction, being generally perpendicular thereto, is then at an angle to the plane of the axis. The transverse component of air flow at each constriction is orthogonal to the direction parallel to the axis and is offset from the plane of the axis in the same sense at each constriction, thus causing a swirling of air within the mixing chamber.

The amount of swirling is dependent upon the thicknesses of the respective members 74 and 76 and upon the shapes of the edges of the openings 80 and 82. These thicknesses and shapes may be determined empirically to provide the desired degree of swirling for a particular engine and a particular carburetor 30. The direction of the flow should not provide so much swirling as to cause the resulting centrifugal forces on the fuel droplets to deposit the fuel upon the inner wall of the inner valve member 76, as this will cause the excessive accumulation of fuel. Such accumulation could result in intermittent drops of fuel falling into the intake manifold 40, thus providing an excessively enriched fuel mixture from time to time beyond what is called for by the controller 48, meanwhile providing a mixture too lean at other times as the fuel accumulates on the inner surface of the inner valve member 76. Of course, some of the swirling air-fuel mixture comes in contact with the inner wall of the inner valve member 76. To facilitate the prompt removal of any accumulating fuel, and hence minimize rich and lean intervals, the second openings 82 extend substantially the length of the mixing chamber 78 and are formed by relatively sharp edges on the inner wall. The swirling air-fuel mixture then acts to scour the inner wall and move fuel to the next opening, where it is stripped from the edge of the opening by the entering air.

The degree of swirling is coordinated with the flow rate and the flow direction as determined by the shapes of the valve members 74 and 76. Where the valve members are conical, it has been found suitable to provide an apex angle, that is, the angle in the plane of the axis 79 between the axis and the conical surfaces of revolution, of about 45°. This provides a substantial axial component of flow while at the same time providing a transverse component as produces the desired swirling. If the apex angle is too great, the axial component is so large that the air-fuel mixture passes from the mixing chamber with relatively little mixing. On the other hand, if the apex angle is made too small, the air-fuel mixture remains too long in the mixing chamber and encourages excessive deposit of fuel on the inner surface of the inner valve member 76. At an apex angle of at least 45°, air as it flows through the constrictions is flowing generally in such direction as to miss the opposite side of the cone if not deflected by another inflowing air stream. Angles greater than 45° therefore further inhibit fuel accumulation on the interior surface of the inner valve member 76. Other criteria may dictate a smaller angle. For example, some engines require a relatively high rate of air flow into a relatively small manifold opening. A smaller apex angle may then be used to provide an air flow area through the overlaps that is large relative to the opening to the manifold.

As shown particularly in FIGS. 2, 3 and 8, the rails 96 are above and parallel to the radial edges 148 of the inner valve member 76. The outer valve member 74 comes between the rails 96 and the second openings 82 except where the first openings 80 overlap the second openings 82. The fuel splitter 132 is held in place with respect to the inner valve member 76 by a set screw 154.

Returning now to a more detailed description of the fuel supply system of the present invention, as shown in FIG. 7, the metering fuel pump 52 used in the present invention is a rotary positive displacement pump, specifically a gear pump. The pump 52 is formed by gears 200 and 202 mounted for intermeshed rotation in a pumping plate 204. The pumping plate 204 is sealed between bearing plates 206 and 208, with this assembly sealed within end plates 210 and 212 and a cover 214. Openings 216, 218 and 220 in end plate 210, bearing plate 206 and pumping plate 204, respectively, are aligned, opening 216 being coupled to the input conduit 53 through which fuel is supplied to the metering pump. The filter 92 may be disposed in these openings. Openings 220, 222 and 224 in pumping plate 204, bearing plate 208 and end plate 212, respectively, are aligned, opening 224 being coupled through an opening 225 in the end plate 212 to the return conduit 58 through which excess fuel is returned to the fuel tank 56. The gears 200 and 202 are rotatably mounted in respective openings 226 and 228 in the pumping plate 204 and are of sizes to fit snugly in the respective openings to minimize leakage while still permitting free turning of the gears.

The gear 200 is an idler gear. The gear 202 is a driven gear driven by the motor 98, which may be a d.c. motor. The motor 98 may drive the gear 202 directly, but preferably through a gear train mounted in the end plate 212 with one end of the gear train driven by the motor shaft 230 and the other end of the gear train driving the driven gear shaft 232. Upon turning of the driven gear 202, teeth of the respective gears 200 and 202 trap fuel from the opening 220 and transport it along the outside of the respective openings 226 and 228 to an opening 234 in the pumping plate 204, the opening 234 communicating with the conduit 60 through openings 236 and 238 in the bearing plate 206 and the end plate 210, respectively. Leakage through the pump 52 is inhibited by the intermeshing of the gears 200 and 202. The reference pressure conduit 66 is coupled through openings 240 and 242 in the end plate 212 and an opening 244 in the bearing plate 208 to the upstream side of the pump 52 to provide the reference pressure to the equalizer valve 62.

The tachometer 100 is connected to the motor shaft 230 and develops the flow rate signal on the conductor 64. The drive signal from the controller 48 is applied over the conductor 50.

The diaphragm 108 is formed of an elastomer that is inert to the fuel. The diaphragm includes a peripheral O-ring section 245 by which the diaphragm 108 is sealed between the upper valve member 104 and the lower valve member 106 in respective annular grooves 246 and 247. Inset a short distance from the O-ring section 245 is an annular corrugation 248. The corrugation fits in an annular groove 249 in the lower valve member 106. The resiliency of the elastomeric material and its thickness provide the desired spring constant upon flexing of the diaphragm 108. The central part of the diaphragm 108 is formed on one side by a relatively rigid member 250 which may be formed of metal providing adequate stiffness at low mass, aluminum alloy 2024-T6 having proven suitable. The rest position of the diaphragm is slightly below the closed position shown in FIG. 8. 0.010 inches has proven satisfactory. The resilience of the diaphragm material at the corrugation 248 acts to bias the equalizer valve 62 toward its closed position with the valve closure member 118 seated in the outlet orifice 116. The diaphragm 108 is thereby self-biased to close the valve 62 when the pump 52 is at rest and not supplying fuel.

Surfaces 251 on the top of the lower valve member 106 act as stops in conjunction with the relatively rigid central member 250 to keep the valve closure member 118 from closing too far and extruding into the outlet orifice 116 so far as to damage the closure member. The surfaces 251 are spaced from one another to permit free flow of fuel to the center of the lower part 114 of the valve chamber 111 to facilitate opening of the valve. A pressure relief passage 252 performs a similar function in respect to the annular groove 249. Raised surfaces 253 on the upper valve member 104 also act as stops in cooperation with the rigid central member 250 to prevent the diaphragm from attaining a position flat against the entire undersurface of the upper valve member 104. The stops 253 are spaced from one another to assure that pressure applied through conduits 122 and 124 is applied across the entire diaphragm for positive closing.

As the outlet orifice 116 communicates through the rail orifices 144 with the interior of the mixing chamber 78, which in turn is exposed to the manifold vacuum, there is a region of pressure imbalance on the diaphragm 108 at the orifice 116 urging the valve closure member 118 toward its closed position. To open the valve 162, this pressure imbalance and the self-biasing of the diaphragm 108 must be overcome by the pressure differential across the rest of the diaphragm 108 as is occasioned by the metering pump 52. As the pressure differential across the pump is to be kept small to minimize leakage, the cross-sectional area of the outlet orifice 116 is made very small relative to the area of the diaphragm 108 so that the valve 62 may be opened by relatively small pressure differentials. This assures linearity of response for the metering pump 52.

Without the equalizer valve 62, a pressure at the inlet side of the metering pump 52 sufficient to preclude bubbles would produce intolerable leakage and excessive non-linearity of the fuel control system. However, with the particular system illustrated, including the particular equalizer valve 62 illustrated, with a diaphragm of appropriate spring constant, it has been found that with a pressure of 40 psi at the inlet side of the metering pump 52, and hence as the reference pressure on the top of the equalizer valve 62, flow starts through the equalizer valve 62 at a pressure differential of about 0.1 psi. Only this pressure differential appears across the gear pump 52, and even at low fuel flow rates this causes relatively negligible leakage. At full fuel flow, the pressure differential is only about 0.6 psi. Although this results in greater leakage through the gear pump 52, it is negligible relative to the greater rate of fuel flow.

As linearity of rate of fuel flow as a function of motor speed is assured by the fuel feed system of the present invention, the feedback signal applied to the conductor 64 by the tachometer 100 is a direct measure of rate of fuel flow. In response to this feedback signal and the signals received from the air flow transducer 44 and other sensors, the controller 48 applies power to the pump motor 98 as causes the metering pump 52 to supply fuel at the desired rate. A small pressure differential across the diaphragm 108 opens the equalizer valve 62 sufficiently to permit the metered fuel to pass out of the outlet orifice 116 into the conduit 130. Necessarily, the valve 62 is opened only far enough to permit the outflow of the metered fuel while maintaining the balancing opening pressure in the lower part 114 of the valve chamber 111.

As the liquid fuel is relatively incompressible, the response of the metering pump motor 98 to the power applied from the controller 48 is transmitted almost instantly to the equalizer valve 62. The equalizer valve 62 therefore becomes the effective control point in the fuel supply system. By putting this control point near the place where the fuel is to be utilized, the response time of the fuel supply system is made relatively short, thus assuring that the system respond promptly to changes in the control signal. The volume of the fuel supply system from the outlet orifice 116 of the equalizer valve 62 to the rail orifices 144 is therefore made a small part of the volume of the fuel path between the gear pump 52 and the mixing chamber 78, and small in respect to the rate of flow of fuel at low engine speeds.

The metered fuel passing through the outlet conduit 130 of the equalizer valve 62 is divided by the flow splitter 132 so as to flow in equal amounts through the respective rails 96. The rail orifices 144 provide outlets through which the fuel may enter the mixing chamber 78. However, it may be noted that when fuel reaches the orifices 144 near the top of the mixing chamber 78, the air flow past these orifices and through the respective overlaps in the openings 80 and 82 aspirates the fuel from the exposed orifices. This is further enhanced by the relatively low pressure within the mixing chamber 78 occasioned by the manifold vacuum created by the pumping action of the pistons of the engine. At the same time, those orifices 144 obstructed by the upper valve member 74 are open to ambient pressure conditions within the housing 38, which are necessarily higher than the manifold vacuum. Hence, air will flow into the lower rail orifices and back up the inside of the rails to where the air meets the fuel coming the other way and passing out of the unobstructed orifices open to the mixing chamber 78.

In the event there should be any flow of fuel to the outside of the outer valve member 74 which is not entrained with air flow through the respective openings into the mixing chamber 78, such fuel is caught by a raised rim 256 on the bottom of the outer valve member 74. The fuel caught by this rim 256 then flows through the bottoms of the openings 80 and 82 into the interior of the carburetor 30.

In general, the first openings 80 are made essentially identical to the corresponding second openings 82, and the respective openings are arranged so that at the limit of throttle closure the openings overlap only at the very top. This provides entry of air and fuel at engine idle at the apex of the throttle, assuring a relatively longer dwell of the air-fuel mixture in the mixing chamber, thus providing better fuel vaporization and air-fuel mixing at idle and low engine speeds, conditions when proper air-fuel mixing are most critical. It may be noted here that additional air at engine idle, and any other conditions as determined by the controller 48, is supplied through the bypass throttle 68 by way of the channel 88 and holes 86 in the skirt 84 of the lower valve member 76.

The shapes of the respective openings 80 and 82 determine the response characteristic of the carburetor 30 and hence the response characteristic of the engine as a function of the position of the accelerator control mechanism. That is, the response of an engine to the operator's positioning of the throttle rod 32 is determined by the shapes of the respective openings 80 and 82. Any number of desirable characteristics can be produced by appropriate shaping of the openings. However, one particular characteristic deserves comment. In the matter of safety of automobile operation, it is important that the operator understand the operating characteristics of the machine. As most automobile operators are accustomed to the response utilizing conventional carburetors with conventional butterfly valves, it is desirable to provide a response characteristic corresponding to that to which the operator is accustomed. To this end, the respective openings are shaped so that air flow as a function of throttle position increases less rapidly at the outset under these circumstances. Relatively large movements of the throttle produce relatively small changes in air flow and hence provide relatively accurate control at smaller air flows, facilitating starting, stopping and parking and careful control at low speeds. Typically, at high speeds accurate control is secondary.

The openings shaped as illustrated, for example, provide a substantially triangular initial overlap. Under these circumstances the area of overlap and hence the rate of air flow increases substantially as the square of throttle displacement until the triangular section covers the entire length of respective openings. After this point the increase in area is a substantially linear function of throttle position.

Figure 14:
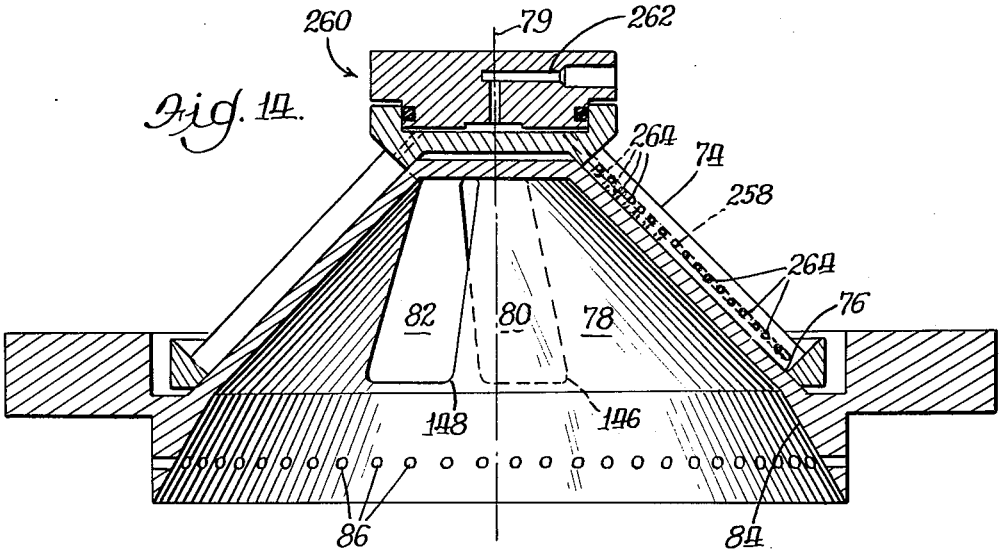
FIG. 14 is a sectional view of another form of carburetor and flow splitter in accordance with the present invention taken along line 14—14 in FIG. 15.
Figure 15:
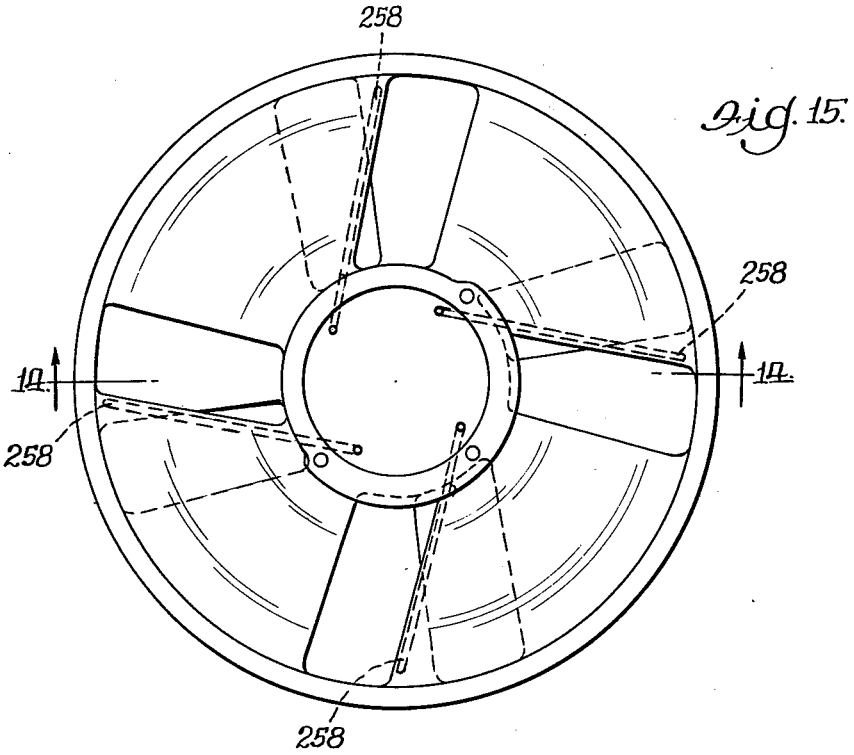
FIG. 15 is a plan view of the carburetor shown in FIG. 14 with the flow splitting device removed.
Figure 16:
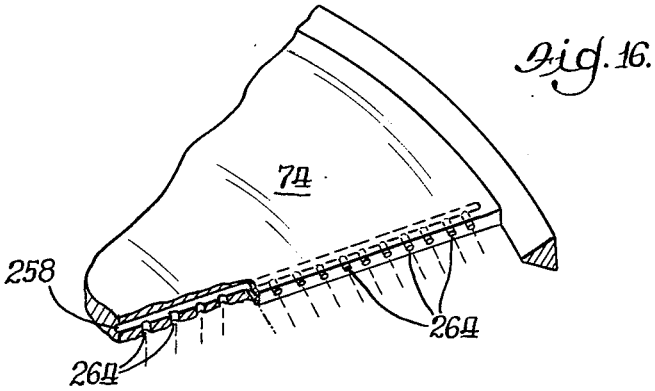
FIG. 16 is a fragmentary isometric view of the carburetor of FIG. 14 showing an internal fuel conduit.

FIGS. 14 to 16 illustrate in alternative form of the carburetor wherein the fuel rails are not formed separately, but rather are in the form of conduits 258 in the upper valve member 74. In this case a flow splitter 260 may take the form illustrated in FIG. 14 which is essentially the inverse of the flow splitter 132 illustrated in FIGS. 8, 12 and 13. In this case the output of the equalizer valve 62 is supplied through a passageway 262 in the flow splitter 260. The flow splitter 260 divides the flow equally among the four conduits 258. In this form of the invention the flow splitter turns with the outer valve member 74, and orifices 264 from the conduits 258 are blocked by the inner valve member 76 where the respective openings do not overlap.

While certain perferred embodiments of the invention have been illustrated and described for particular engines, particular air-fuel control systems, and particular conditions, it should be understood that many modifications can be made to the system within the scope of the present invention. For example, in a modification of the fuel distribution system shown in FIGS. 14 to 16, the conduits 258 can be formed by separate tubing, like the rails 96 but mounted on and carried by the upper valve member 74, spaced from the edges of the openings 80 to permit air flow between the conduits 258 and the respective edges of the respective openings. In a modification of the rails 96, the rail orifices 144 are in the form of slots. In a further modification, there is a single slot for each rail.

What is claimed is:

1. A fuel supply system for supplying volatile fuel at a controlled rate to an air-fuel mixing chamber leading to a subatmospheric intake manifold of an internal combustion engine, said system comprising:

a positive displacement rotary metering pump having an inlet side and a discharge side for pumping fuel from said inlet side to said discharge side, fuel pump means for supplying volatile fuel from a fuel reservoir to said inlet side at a substantial elevated pressure at which said fuel remains liquid passing through said metering pump, equalizer valve means including a valve body forming a valve chamber with an outlet opening therefrom, a resilient diaphragm dividing said valve chamber into first and second parts with said outlet opening in said first part and mounted in said valve body for movement by pressure differentials between said first and second parts, a valve closure member for closing said outlet opening supported in said valve chamber by said diaphragm for motion therewith, and means biasing said diaphragm to effect closure of said outlet opening by said valve closure member when the pressure in said first part is less than a small differential greater than the pressure in said second part, said small predetermined differential being insufficient to produce any substantial leakage of liquid through said metering pump, first fluid conduit means connecting said discharge side of said metering pump to said first part of said valve chamber, second fluid conduit means connecting said inlet side of said metering pump to said second part of said valve chamber, third fluid conduit means for connecting said outlet opening from said valve chamber to said air-fuel mixing chamber, a variable speed electrical pump motor coupled to said metering pump for driving said metering pump, control means for providing an electrical control signal systematically related to a desired rate of fuel supply, speed measuring means coupled to said metering pump for producing a feedback signal systematically related to metering pump speed, and circuit means responsive to said control signal and said feedback signal for providing electrical power to said pump motor to drive said motor at a controlled rate whereat said positive displacement metering pump pumps said volatile fuel at substantially the desired rate from said inlet side to said discharge side, whence said fuel flows at substantially said desired rate through said first conduit means to said first part of said valve chamber wherein it produces pressure relative to that in said second part whereat said valve closure member is positioned relative to said outlet opening for said fuel to flow therethrough at said desired rate to said air-fuel mixing chamber.

2. A fuel supply system according to claim 1 wherein said positive displacement rotary metering pump is a gear pump.

3. A fuel supply system according to claim 1 wherein the area of said outlet opening is a relatively negligible fraction of the area of said diaphragm.

4. A fuel system according to claim 1 wherein said fuel pump means comprises a fuel pump and a pressure regulator producing a fuel pressure of at least 30 psi at said inlet side of said metering pump.

5. A fuel system according to claim 1 wherein said means biasing said diaphragm includes means for mounting said diaphragm with its rest position displaced in the closing direction beyond its position when said valve closure member closes said outlet opening.

6. A fuel system according to claim 1 wherein said diaphragm has a relatively flat rigid central portion surrounded by an annular corrugation of flexible material, and said valve closure member is at substantially the center of said central portion on the side thereof defining said first part of said valve chamber.

7. A fuel system according to claim 6 wherein said valve body includes a first body member with said outlet opening therein, said first body member having stop means for stopping the motion of said central portion to limit the entry of said closure member into said outlet opening, and means for providing entry of liquid between said diaphragm and said first body member substantially entirely across said diaphragm.

8. A fuel system according to claim 7 wherein said valve body includes a second body member having stop means for stopping the motion of said central portion to limit contact of said diaphragm with said second body member.

9. A fuel system according to claim 1 wherein the volume of the flow path of said third fluid conduit means from said outlet opening to said mixing chamber is small in respect to the rate of flow of fuel at low engine speeds, thereby providing short response time for the supply of fuel to said engine in response to changes in said control signal.

10. A fuel system according to claim 9 wherein said outlet opening is disposed near said mixing chamber and said total volume of the flow path of said third fluid conduit means is small relative to the volume of the entire total fuel flow path from said metering pump to said mixing chamber.

11. A fuel system according to claim 1 wherein said third fluid conduit means includes means defining a plurality of fuel passages for separately directing fuel to said mixing chamber, and flow splitting means for dividing fuel flowing through said outlet opening to flow substantially equally through the respective fuel passages.

12. A fuel system according to claim 11 wherein said flow splitting means comprises means defining a receptacle open to said outlet opening, and a pair of closely spaced walls extending away from said receptacle to said fuel passages, said fuel passages being uniformly distributed about said receptacle and equidistant therefrom, the spacing between said walls from said receptacle to said fuel passages being substantially the same for all passages and providing a constriction in fuel flow relative to flow through said receptacle.

13. A fuel system according to claim 12 wherein said means defining said fuel passages provides a series of outlet orifices along each of said passages for introducing fuel into said mixing chamber.

14. A fuel system according to claim 13 wherein said fuel passages extend along said mixing chamber and are uniformly spaced thereabout.

15. A fuel system according to claim 14 wherein said means defining said fuel passages comprises a plurality of tubes extending along said mixing chamber.

16. A fuel distribution system for distributing fuel to an air-fuel mixing chamber of an internal combustion engine, said system comprising:

means for supplying fuel through an outlet conduit, receiving means defining a receptacle open to said outlet conduit for receiving fuel supplied therethrough, means defining a plurality of fuel passages for separately directing fuel to said mixing chamber, and a pair of closely spaced walls extending away from said receptacle to said fuel passages, said fuel passages being uniformly distributed about said receptacle and equidistant therefrom, the spacing between said walls from said receptacle to said fuel passages being substantially the same for all passages and providing a constriction in fuel flow relative to flow through said receptacle.

17. A fuel distribution system according to claim 16 wherein said means for supplying fuel includes valve means for controlling the effective cross section of flow to said outlet conduit, and means for controlling the rate of flow of fuel to said outlet conduit.

18. A fuel distribution system according to claim 16 wherein said means defining said fuel passages provides a series of outlet orifices along each of said passages for introducing fuel into said mixing chamber.

19. A fuel distribution system according to claim 18 wherein said fuel passages extend along said mixing chamber and are uniformly spaced thereabout.

20. A fuel distribution system according to claim 19 wherein said means defining said fuel passages comprises a plurality of tubes extending along said mixing chamber.

* * * * *